United States Patent [19]

Joyce

[11] Patent Number: 4,636,111

[45] Date of Patent: Jan. 13, 1987

[54] APPARATUS FOR ROAD REPAIR WORK INCLUDING A PROTECTIVE CAGE

[75] Inventor: James V. Joyce, Andover, N.Y.

[73] Assignee: Joyce Pipe Line Company, Andover, N.Y.

[21] Appl. No.: 758,893

[22] Filed: Jul. 25, 1985

[51] Int. Cl.[4] ..... E01C 19/16

[52] U.S. Cl. ..... 404/101; 404/108; 52/143; 296/181

[58] Field of Search ..... 404/108, 110, 101; 52/79.1, 106, 143; 296/181, 182; 280/462, 463, 490 R, 656

[56] References Cited

U.S. PATENT DOCUMENTS

| | | | |
|---|---|---|---|
| 4,016,951 | 4/1977 | Dick et al. | 52/143 |
| 4,322,178 | 3/1982 | Lee | 404/83 |
| 4,552,341 | 11/1985 | Zucker et al. | 404/6 |
| 4,557,626 | 12/1985 | McKay et al. | 404/108 |

FOREIGN PATENT DOCUMENTS

| | | | |
|---|---|---|---|
| 2844174 | 4/1979 | Fed. Rep. of Germany | 296/181 |

*Primary Examiner*—James A. Leppink
*Assistant Examiner*—Terry Lee Melius
*Attorney, Agent, or Firm*—Millen & White

[57] ABSTRACT

Road working apparatus, towed by a road working vehicle, such as a truck, includes a cage portion for protecting workers performing tasks such as filling potholes. The cage has an opening through the floor, which opening is positioned over the pothole. If necessary the size of the opening can be increased by pivoting up one or more grates. Preferably the apparatus includes machinery and equipment necessary to perform the particular task at hand, such as a hot patch and blacktop dispersing unit, a generator and an air compressor for powering road working tools.

11 Claims, 8 Drawing Figures

APPARATUS FOR ROAD REPAIR WORK INCLUDING A PROTECTIVE CAGE

BACKGROUND OF THE INVENTION

The instant invention relates to road repair apparatus, and more particularly the instant invention relates to road repair apparatus which is towed behind a vehicle.

TECHNICAL CONSIDERATIONS AND PRIOR ART

Repairing potholes, water lines, sewer lines, telephone lines and electrical lines is a major activity in the maintenance of a modern society's infrastructure. Hundreds of thousands of workers are employed to perform these activities. For each worker or group of workers repairing a road or utility line it is necessary to employ one or more flag wavers to divert traffic from the work area. Flag waving is both expensive to the municipality or utility employing the flag waver and dangerous to the flag waver. Each year, numerous flag wavers are injured and several are killed while performing their task. They cannot keep their eyes on the traffic as well as on the frequently dangerous activities occurring behind them. Often, they fall into holes or back into hot or moving machinery while directing or dodging traffic. Generally, flag waving is not an occupation pursued with enthusiasm. Some flag wavers are so ineffective, that from time to time repair crews do not even utilize them which of course increases the danger to the crews. On occasion, vehicles have been known to hit the workers on the crews or to knock their equipment into them. Road work is a rather hazardous occupation, the hazards of which need to be minimized.

SUMMARY OF THE INVENTION

It is an object of the instant invention to provide road repair apparatus which minimizes the hazards from vehicular traffic to which road workers are exposed.

Upon further study of the specification and appended claims, further objects and advantages of this invention will become apparent to those skilled in the art.

The instant invention contemplates road working apparatus adapted for towing behind a vehicle wherein the road working apparatus includes a trailer with a frame, the frame including wheels thereunder and a trailer bed thereover. The trailer bed supports road working equipment. In front of the frame there is mounted a working cage, the working cage having front and rear ends, a pair of opposed sides and a floor. The floor of the cage has an opening therein which separates front and rear portions of the floor. In operation, the cage is towed to a work area and the opening in the floor of the cage is positioned over the work area so that the work area is accessible to workers in the cage.

The instant invention further contemplates utilizing equipment which is especially adapted for repairing potholes and positioning that equipment on the trailer behind the cage while providing the cage with a shelf so as to facilitate receiving asphalt from the vehicle which is used to tow the road working apparatus.

Moreover, the instant invention contemplates a road working apparatus having a cage providing a protective area for workers, wherein the cage is raised from the road surface for towing and lowered to the road surface when repair work is to be performed.

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein.

DESCRIPTION OF THE PREFERRED EMBODIMENT

Figure 1:
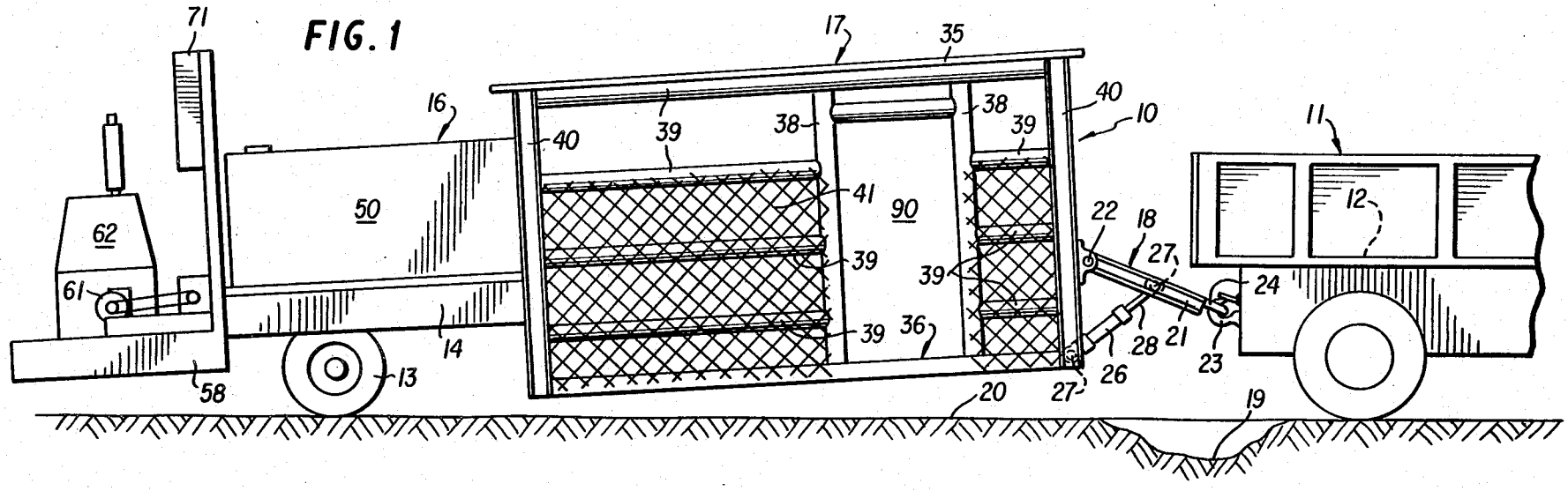
FIG. 1 is a side view of the instant invention showing a towing vehicle pulling apparatus for road work.
Figure 2:
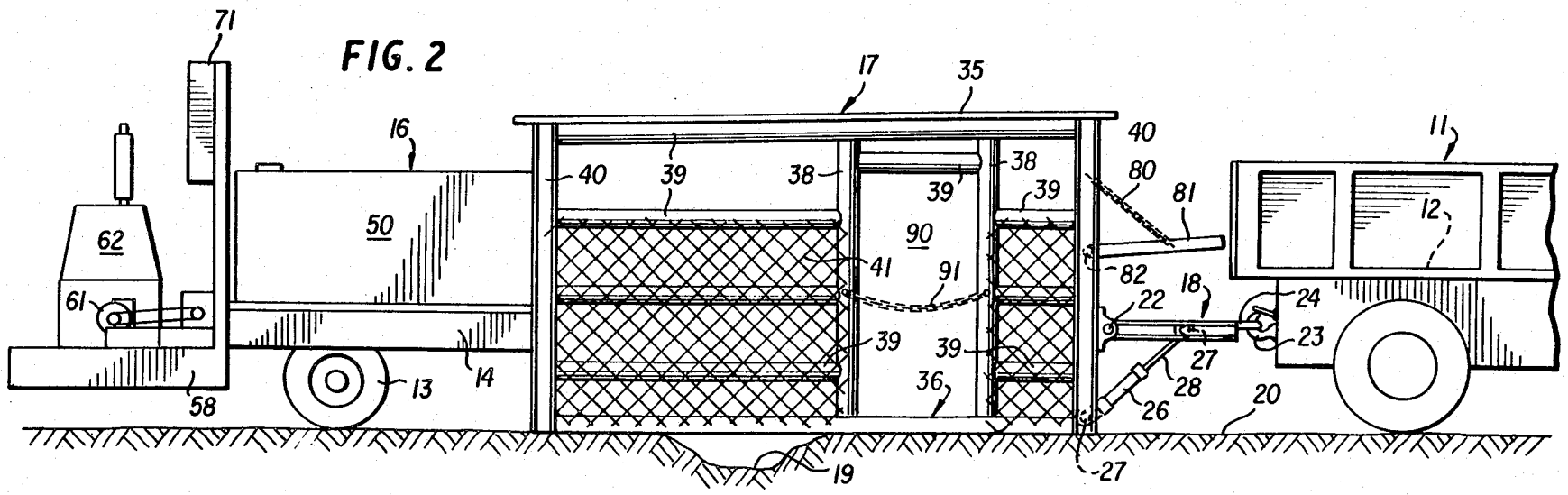
FIG. 2 is a view similar to FIG. 1 but showing the apparatus lowered onto the surface of a road.

Referring now to FIGS. 1 and 2, there is shown road repair apparatus, designated generally by the numeral 10, configured in accordance with the principles of the instant invention, which road repair apparatus is being towed by a road repair vehicle such as a truck, designated generally by the numeral 11. The truck 11 is preferably a dump truck having a bed portion 12 for carrying road repair material such as asphalt. The road repair apparatus 10 is configured as a trailer which rolls on a pair of wheels 13 disposed adjacent the rear end of the trailer. The trailer has a first portion in front of the wheels 13 and a second portion behind the wheels. Above the wheels 13 there is a frame 14 which forms a trailer bed that supports equipment, designated generally by the numeral 16. In accordance with one embodiment of the invention, the equipment may be specialized equipment for use in repairing potholes. Just forward of the trailer bed 14, there is positioned a protective cage, designated generally by the numeral 17, which, in accordance with the principles of the instant invention, is designed and configured to protect road workers. Forward of the cage 17 there is a coupling, designated generally by the numeral 18 for attaching the road repair apparatus 10 to the tow vehicle 11. In accordance wtih a preferred embodiment of the invention, the cage 17 is fixed with respect to the frame 14.

When the towing vehicle 11 arrives at a pothole 19 or another anomaly in the road 20, the cage 10 is lowered from the FIG. 1 position to the FIG. 2 position. This can be accomplished by configuring the coupling 18 with a rigid A-frame link 21 that is pivoted to the cage 17 by pivot 22 at one end and connected to the hook 23 of the towing vehicle 11 by an eye 24 or the like. A hydraulic cylinder 26 has its cylinder portion pivoted to the cage 17 at pivot 27 and the free end of its rod portion 28 pivoted to the link 21 at pivot 29. Upon extending the rod 28 from cylinder 26 the cage 17 is lowered from its FIG. 1 position, wherein it is in spaced relation with the road, to its FIG. 2 position wherein the cage rests on the road.

Figure 3:
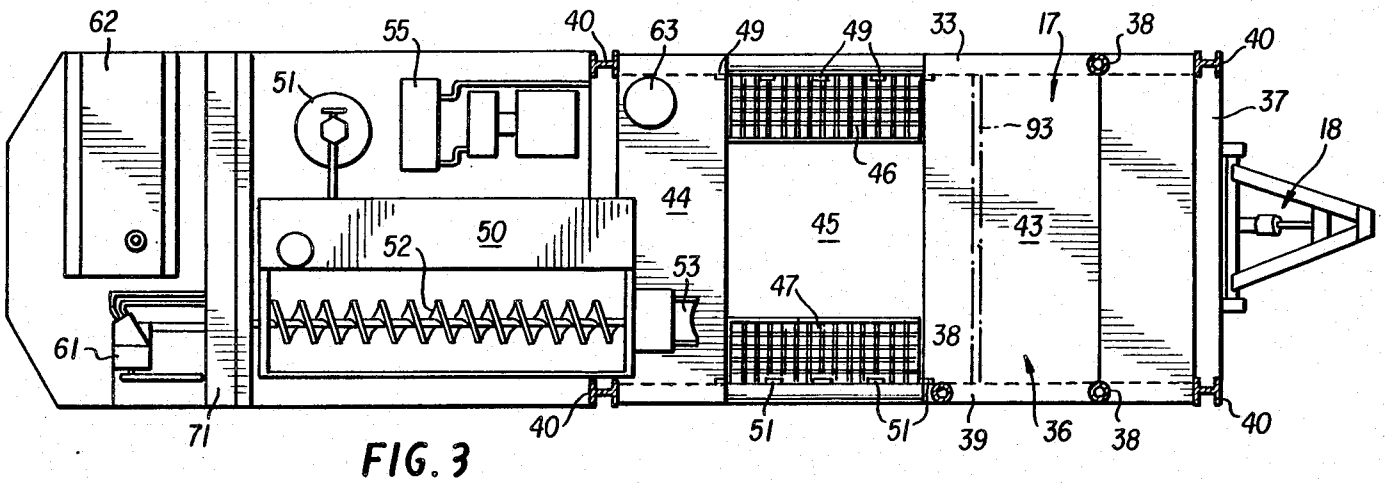
FIG. 3 is a top view of the apparatus of FIGS. 1 and 2.
Figure 5:
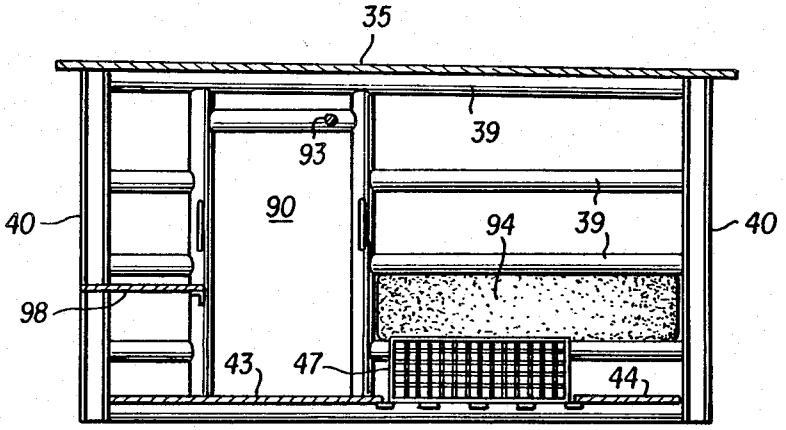
FIG. 5 is a view showing the inside right wall of the protective cage shown in FIGS. 1–3.

Referring now to FIG. 3 in conjunction with FIGS. 1 and 2, it is seen that the cage 17 has a pair of opposed side walls 33 and 34, a roof 35, a floor area designated generally by the numeral 36, and a front wall 37. In accordance with one embodiment of the invention, the side walls 33 and 34 are formed by steel columns 38 which are connected by horizontally extending steel beams 39. Steel I-beams 40 are positioned at each corner of the cage 17. In order to provide for ventilation as well as to inhibit intrusion through the side of the cage 17, the sides of the cage 17 are covered with steel mesh 41. It is necessary to keep the cage open due to the fumes which arise from asphalt, blacktop and hotpatch materials. It is also necessary to keep the cage open in order to allow the considerable heat generated by these processes to escape. The roof 35 may be made of any material such as corrugated steel or corrugated fiberglass sheets. The roof keeps the sun off of the workers as well as protecting them to a considerable degree from rain and snow.

Referring now specifically to the floor area 36, it is seen that the floor area has a front portion 43 and a rear portion 44 which are separated by an open work area 45. The open work area 45 has a pair of grates 46 and 47 positioned therein, which grates are hinged by hinges 49 and 51 to the sides 33 and 34 respectively of the cage 17. If it is necessary to enlarge the opening of the work area 45, one or both of the grates 46 and 47 may be pivoted up to a vertical position against the sides 33 and 34 of the cage 17 and latched by suitable means to the sides of the cage.

At this point, it should be readily apparent that the cage 17 can be used to work on any area of a road. While the preferred embodiment is configured for filling potholes, the cage 17 can be positioned over manhole covers, water access valves, expansion cracks or whatever occurrence in the middle of a road deserves attention.

Figure 7:
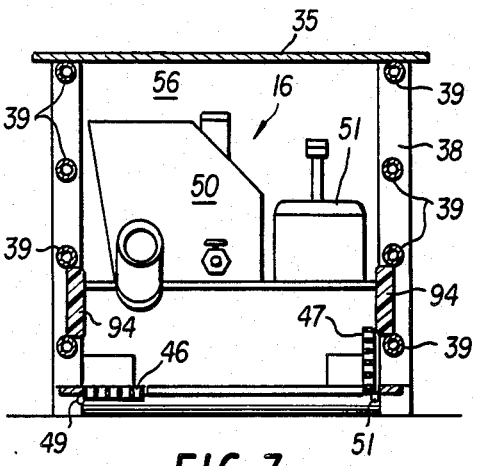
FIG. 7 is an inside view of the rear of the cage.

In the preferred embodiment, the frame 14 positioned behind the cage 17 supports a hot sealer and blacktop tank 50, which tank utilizes a propane burner fueled by a propane storage tank 51 and an auger 52 for advancing the melted blacktop to an outlet 53 positioned in the cage 17. Positioned beside the tank 50 is the hydraulic systems 5 which comprises a hydraulic pump for powering the auger 52 and the hydraulic cylinder 26 used to raise and lower the cage 17. Referring now to FIG. 7, there is shown an opening 56 in the rear end 38 of the cage 17 which provides access from the cage to the equipment 16.

Figure 4:
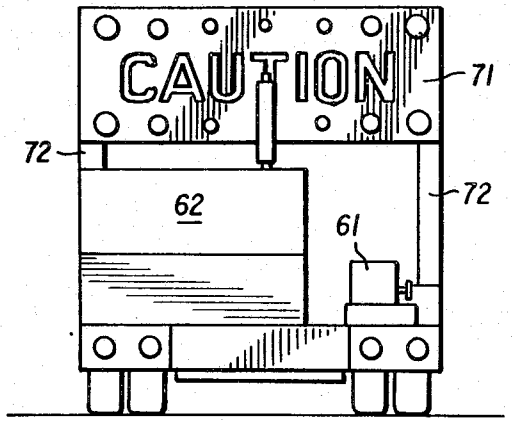
FIG. 4 is a rear view of the apparatus of FIGS. 1–3.
Figure 6:
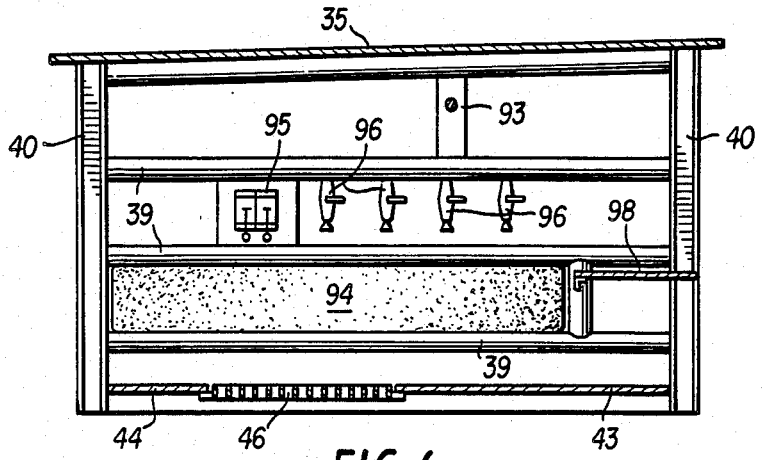
FIG. 6 is an inside view of the left wall of the cage shown in FIGS. 1 through 3.

Behind the wheel 13 there is positioned an additional shelf 58 on which is mounted an air compressor 61 an electric generator 62 driven by a gasoline or diesel engine. The air compressor 61 provides compressed air for various pneumatic tools (not shown) which are stored in a container 63 positioned on the rear floor 44 in the cage 17. The generator 62 mounted on shelf 58 provides any electric current which is needed for the apparatus 10. A primary need for electric current is a caution sign 71 which is positioned on a frame 72 extending above the apparatus 10 (see FIG. 4). Most caution signs are relatively large and must be visible in daylight. Consequently, they consume considerable electric current and it is necessary to have a separate power source such as the generator 62 to illuminate such signs.

Figure 8:
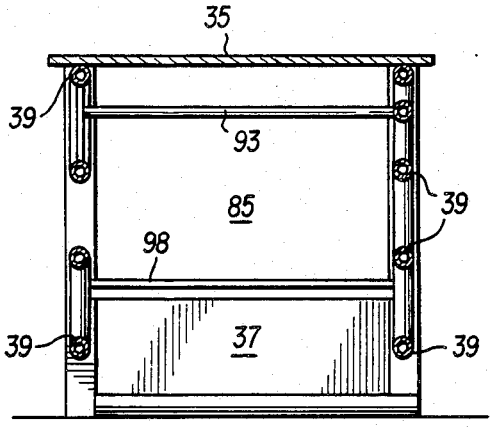
FIG. 8 is an inside view looking toward the front of the cage.

Referring now more specifically to the front wall 37 of the cage 17, it is seen that the front wall includes a shelf 81 which is pivoted to the front wall by hinges 82 and pivots downwardly toward the bed 12 of the truck 11 (see FIG. 2). The shelf 81 remains generally horizontal with a slight incline toward the cage 17 by virtue of being restrained by a pair of chains 83 on each side thereof. The front wall 37 of the cage 17 has an opening 85 (see FIG. 8) therethrough so that material, such as asphalt can be unloaded from the truck 11 onto the platform 81 and passed through the opening 85 for use in filling the pothole 19 over which the cage 17 is positioned. In accordance with a preferred embodiment of the invention, one worker stands on the front portion 43 of the floor 36 and fills the pothole with asphalt from the truck 11, while another worker patches the filler hole with blacktop and sealer from the tank 50. If it is necessary to trim the pothole 19 or clean it out prior to filling, both workers have at their disposal the necessary conventional pneumatic tools stored in container 63 and a source of pneumatic power from the air compressor 61.

The cage 17 has an opening 90 in one side thereof which serves as an entry and exit. The opening 90 can be protected with a chain 91. The cage 17 is equipped with ammenities such as a horizontally extending handrail 93 and pads 94 on the sides of the cage to protect the workers from injury and discomfort should they bump into the sides of the cage while shovelling or digging. While the apparatus 10 is being used to repair a road, it is, of course, preferable that the workers remain in the cage 17. Accordingly, the controls 95 for operating the auger 52 and hydraulic cylinder 26 are positioned on wall 33 as are a series of pneumatic hookups 96 which supply compressed air to pneumatic tools from the compressor 61. In addition, there is an internal shelf 98 just beneath the opening 85 in the front wall 37 of the cage 17 which can be used both as a work bench or as a temporary storage for blacktop or asphalt received from the truck 11.

The road working apparatus 17 in accordance with the instant invention provides a safe work area for road workers performing such tasks as filling potholes. The cage 17 protects workers from traffic while the organization of equipment allows them to perform their tasks quickly and efficiently.

By configuring the apparatus 10 so that the wheel 13 projects below the frame 14 a distance substantially equal to the distance that the floor 36 of cage 17 projects below the frame while projecting the floor of cage below the frame a greater distance than the shelf 58, the apparatus can be easily towed from one location to another, yet rests substantially parallel to the road surface when used to protect workers.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Apparatus for road repair work, wherein the apparatus is configured to be coupled to and towed by a road repair vehicle, the apparatus comprising:

trailer means for supporting the apparatus and allowing the apparatus to be towed over a roadway by the vehicle, the trailer means including a pair of wheels mounted on a frame about which wheels the apparatus pivots;

the frame including first and second portions wherein the first portion has the pair of wheels mounted on the bottom thereof and a trailer bed for supporting road working equipment;

cage means secured to the first portion, said cage means having front and rear ends, opposed sides and a floor wherein, the front and rear ends have openings therethrough, the rear end opening communicating with the bed portion of the trailer so as to render the equipment thereon accessible to workers in the cage, while the front end of the cage has an opening therethrough whereby material carried by the towing vehicle is accessible to workers within the cage, and the floor of the cage having front and rear portions spaced by an opening defining a work area, whereby when the road repair apparatus is positioned over the work area, workers standing on the front and rear portions of the floor can work in the opening while being protected from traffic and while having the materials and tools necessary for their work conveniently positioned adjacent to the work area, the floor of the cage extending below the trailer bed and below the bottom of the first portion substantially the same distance that the wheels extend therebelow whereby the apparatus when utilized rests substantially parallel to the road surface but can be conveniently towed by raising the front end of the cage portion.

2. The apparatus of claim 1 wherein the work area has a pair of panels hinged adjacent the sides of the cage for allowing a selective increase in the size of the opening by pivoting the panels upwardly.

3. The apparatus of claim 1 further including sign means disposed proximate the rear of the apparatus, said sign means displaying a warning to the drivers of other vehicles using the road.

4. The road repair apparatus of claim 1 further including means for raising and lowering the front end of the cage with respect to the road surface and with respect the vehicle towing the apparatus while the apparatus is coupled to the vehicle.

5. The road repair apparatus of claim 4 wherein the means for raising and lowering the cage comprises a link pivoted at one end of the cage and having means for attachment to the vehicle at the other end, the link having a hydraulic cylinder disposed between the link and the cage whereby expansion of the hydraulic cylinder lowers the cage to the road surface.

6. The apparatus of claim 1 wherein the equipment is specifically used for pothole repair work and includes a tank for storing blacktop and hot tar and dispensers for blacktop and hot tar and as well as a generator, air compressor means used for pothole cleaning, and trimming equipment carried within the work area of the cage.

7. The apparatus of claim 6 wherein the air compressor and electrical generator are located rearwardly of the trailer wheel means on the second portion of the trailer frame which is positioned behind the tank for storing blacktop and hot tar the tank being located over the pair of wheels.

8. The apparatus of claim 1 further including a ramp pivoted to the front end of the cage, which ramp pivots downwardly so as to provide a surface for receiving and retaining material from the vehicle until the material can be used for road repair work.

9. The apparatus of claim 8 wherein an internal shelf is provided adjacent the open end of the front of the cage for receiving asphalt from the towing vehicle and the pivoting shelf.

10. The apparatus of claim 9 wherein an access door is provided in the side wall at a location adjacent the front portion of the floor.

11. The apparatus of claim 10 wherein an elevated handrail is provided in alignment with the opening of the door.

* * * * *